United States Patent [19]

Longsworth

[11] 4,150,549

[45] Apr. 24, 1979

[54] CRYOPUMPING METHOD AND APPARATUS

[75] Inventor: Ralph C. Longsworth, Allentown, Pa.

[73] Assignee: Air Products and Chemicals, Inc., Allentown, Pa.

[21] Appl. No.: 797,282

[22] Filed: May 16, 1977

[51] Int. Cl.[2] ..... F17C 7/02

[52] U.S. Cl. ..... 62/55.5; 62/268; 55/269; 55/DIG. 15

[58] Field of Search ..... 62/55.5, 100, 268; 55/269, DIG. 15

[56] References Cited

U.S. PATENT DOCUMENTS

| | | | |
|---|---|---|---|
| 3,168,819 | 2/1965 | Santeler | 62/55.5 |
| 3,175,373 | 3/1965 | Kolkeboer et al. | 62/55.5 |
| 3,338,063 | 8/1967 | Hogan et al. | 62/55.5 |
| 3,360,949 | 1/1968 | Blanchard et al. | 62/55.5 |
| 3,390,536 | 7/1968 | Kreisman | 62/55.5 |
| 3,536,418 | 10/1970 | Breaux | 62/55.5 |
| 3,579,998 | 5/1971 | Thibault et al. | 62/55.5 |
| 3,585,807 | 6/1971 | Hengevoss et al. | 62/55.5 |
| 3,620,029 | 11/1971 | Longsworth | 62/55.5 |
| 3,625,019 | 12/1971 | Osterstrom | 62/55.5 |

OTHER PUBLICATIONS

Turner, F. T. et al.: *Small Cryopump with Integral Refrigerator,* vol. 3, No. 5, Journal of Vacuum Science & Tech., N.Y. 1966, pp. 252–257.

Gareis, P. J. et al.: *Cryosorption Pumping of He & H,* Cryogenic Engin. News, Oct. 1967, pp. 26–30, Cleveland, Ohio.

Visser, J. et al.: *A Versatile Cryopump for Industrial Vacuum Systems,* Gr. Britain, Pergamon Press Ltd.

*Primary Examiner*—Ronald C. Capossela

*Attorney, Agent, or Firm*—James C. Simmons; Barry Moyerman

[57] ABSTRACT

Cryopumping speed of nitrogen, helium, hydrogen and neon can be increased by omitting the chevron baffle in a conventional cryopump and preventing incident radiation of about 300° K. from striking surfaces used to cryosorb helium, hydrogen and neon. An apparatus is disclosed utilizing three pumping surfaces created from open ended opposed nested cylinders. A radiation absorbent coating is placed on one of the surfaces to shield the helium, hydrogen and neon pumping surface. Refrigeration can be provided by a two-stage closed cycle cryogenic refrigerator.

5 Claims, 1 Drawing Figure

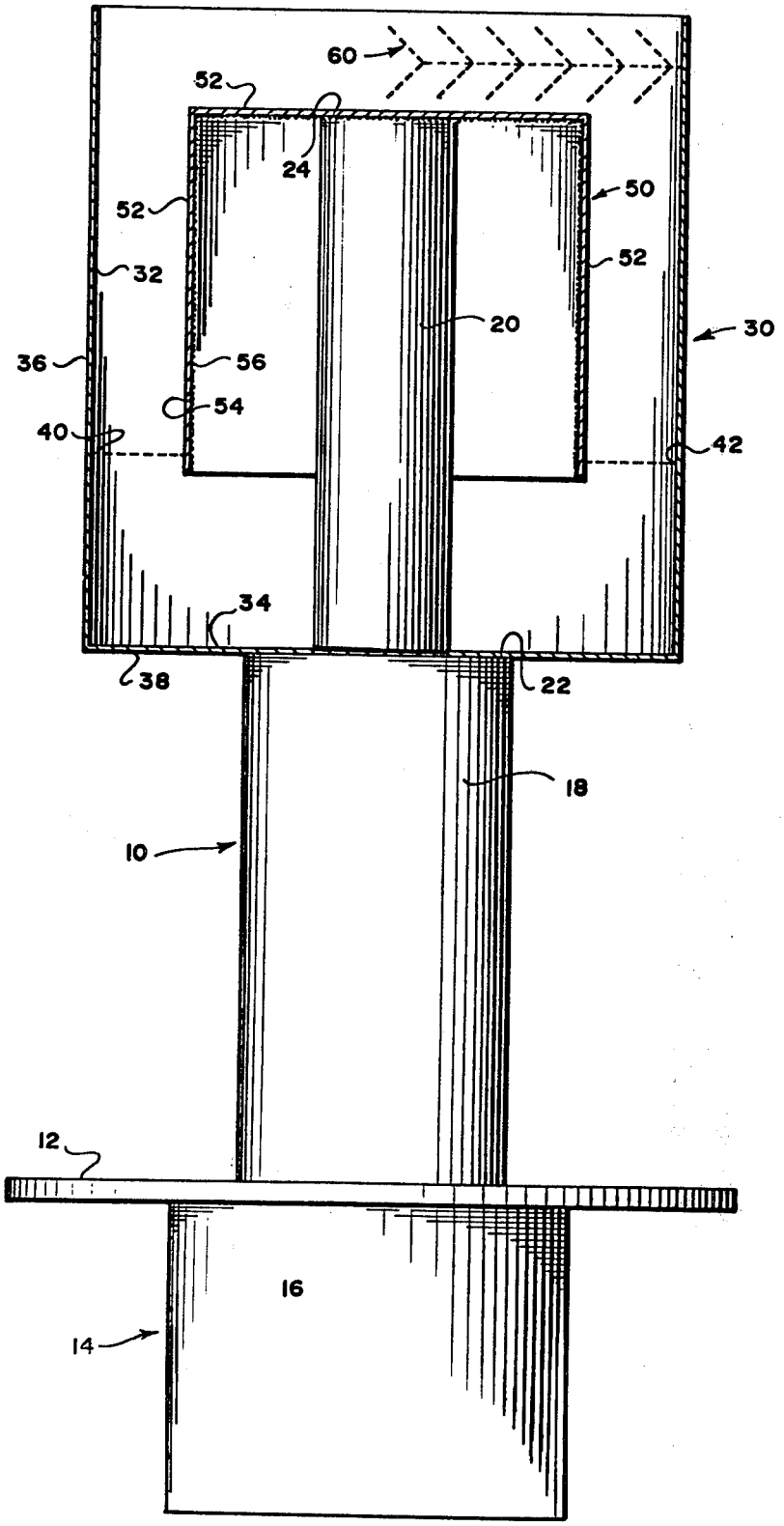
60
52
24
52
50
52
32
20
30
36
56
54
40
42
34
38
22
18
10
12
16
14

CRYOPUMPING METHOD AND APPARATUS

BACKGROUND OF THE INVENTION

1. Field of the Invention

This invention relates to creation of ultra-high vacuums utilizing cryopumps by the capture of gas molecules on extremely cold surfaces from enclosed volumes which have already been reduced to a very low pressure by mechanical or diffusion pumps. Cryopumping achieved its first major application in the early stages of the space program where it was used in large space simulation chambers, rocket exhaust test chambers, and a low density wind tunnel. The advantages of cryopumping reside in providing a clean vacuum and achieving high pumping speeds economically in comparison to conventional pumping techniques, thus creating a continuing interest in improving cryopumping methods and apparatus.

2. Description of the Prior Art

Cryopumping (cryogenic pumping) devices have in the past used three surfaces to remove different gases from the vacuum environment. These surfaces generally have been cooled to various temperatures below 120° K. These surfaces have been used to remove water and carbon dioxide (by freezing in the temperature range of 40° to 120° K.); nitrogen, oxygen, argon, carbon monoxide, methane and halogenated hydrocarbons (by freezing at temperatures between 10° and 25° K.) and helium, hydrogen and neon (by cryosorption at temperatures of 10° to 25° K.). Cryosorbtion is adsorbing gases in a sorbent at cryogenic temperatures. One type of three surface device is disclosed in U.S. Pat. No. 3,390,536. Patentee discloses a liquid cooled (nitrogen and helium) cryopump having three surfaces, the first of which is a removable surface radiation shield which blocks water vapor and carbon dioxide from contacting the second and third surfaces. All of the surfaces of the patentee's device are highly polished so that an appreciable amount of radiation is transmitted inside the device. This radiation can impinge on the third surface.

Another three surface device is disclosed in U.S. Pat. No. 3,579,998. Patentee discloses the traditional concept of using a chevron baffle to block water vapor and carbon dioxide from contacting the second and third surfaces. In addition, a second chevron baffle is used to prevent nitrogen, oxygen, argon, carbon monoxide, methane and halogenated hydrocarbons from contacting the third surface. The device is based on the geometry of the system and employs liquid cooling of the surfaces.

U.S. Pat. No. 3,168,819 discloses a diffusion pump cold trap which uses a single surface for cryopumping.

U.S. Pat. No. 3,338,063 discloses a variable area cryopanel but does not discuss a three surface technique for cryopumping.

U.S. Pat. No. 3,485,054 discloses operation of cryopumps in the range of from $10^{-1}$ to $10^{-5}$ Torr. This patent does disclose high thermal mass cryopanels to permit fast pump-down of a chamber from high initial pressure by enclosure of the cryopanels in a separate dewar that permits the cryopanels to remain cold while gases are being pumped out of the system.

U.S. Pat. No. 3,585,807 discloses a means for controlling the exposure of a cryopanel to heat and gas loads by a moveable shield panel.

Several technical papers have been presented which review cryopumping in the industrial environment. An article entitled "A Versatile Cryopump for Industrial Vacuum Systems" by J. Visser, B. Symersky, and A. J. M. Geraerts, which will appear in the publication Vacuum published by Pergamon Press Ltd., Great Britain, has been made available to workers in the field. This paper discloses using a closed cycle refrigerator for cooling three pumping surfaces in a cryopump.

An overall review of closed cycle refrigerators coupled to cryopanels can be obtained in the article entitled "Small Cryopump With Integral Refrigerator" by F. T. Turner and W. H. Hogan, appearing in Volume 3, No. 5 of the Journal of Vacuum Science and Technology, pages 252–257, published by the American Institute of Physics, New York, 1966.

Use of absorbent materials cooled to cryogenic temperatures is discussed in an article by P. J. Gareis and S. A. Stern entitled "Cryosorption Pumping of Helium and Hydrogen" pp. 26–30, Cryogenic Engineering News, October 1967, published by Thomas Publishing Co., Cleveland, Ohio.

In addition, technical literature is available from the large vacuum systems manufacturers such as Balzers, Veeco, and Varian, Inc.

SUMMARY OF THE INVENTION

In order to provide a vacuum pump capable of increased cryopumping speeds, it has been discovered that when incident radiation of about 300° K. is prevented from striking the adsorption surface used to cryopump helium, hydrogen and neon, the overall helium pumping speed is increased and cleaner vacuums at levels below $10^{-6}$ Torr. can be achieved. Further, significant increases in pumping helium, hydrogen and nitrogen can be achieved by eliminating the chevron baffle.

Two open ended cryopanels in the form of cylinders (cups) can be nested in an opposed relationship so that three separate cyropumping surfaces are defined. The surfaces can be treated to provide for cryopumping of different gases and for preventing incident radiation from striking the cryopumping surface used to remove helium, hydrogen and neon.

Therefore, it is the primary object of this invention to provide an improved cryopumping apparatus.

It is a further object of this invention to provide a method for improving cryopumping devices by shielding the surface used to cryopump helium, hydrogen and neon from incident radiation of approximately 300° K.

It is yet another object of this invention to provide a cryopump cooled by a closed cycle refrigerator.

BRIEF DESCRIPTION OF THE DRAWING

The single FIGURE of the drawing is a schematic representation of an apparatus according to the present invention which also illustrates the method of the present invention.

DESCRIPTION OF THE PREFERRED EMBODIMENTS

Referring to the single FIGURE of the drawing, the cryopump apparatus is shown generally by the numeral 10. Cryopump 10 includes a base or adaptor plate 12, which plate can be affixed to a vacuum chamber by any convenient fastening means such as bolts, rivets, or welds. The base plate facilitates mating of the cryopump 10 to the vacuum chamber (not shown). In most vacuum chambers, the preferred installation would permit removing the cryopump so that necessary holes would be included in base plate 12. These are not shown in the drawing as this is within the skill of the art.

Projecting through and affixed to base plate 12, is a two stage cryogenic refrigerator shown generally as 14, including a motor and control housing 16 on one side of base plate 12 and a first refrigeration stage 18 and second refrigeration stage 20 on the other side of base plate 12 adapted to project into the vacuum chamber. A preferred cryogenic refrigerator is model CS-202 offered for sale by Air Products and Chemicals, Inc. under the trademark DISPLEX. The refrigerator is also disclosed in U.S. Pat. No. 3,620,029, which patent specification is incorporated herein by reference. The refrigerator operates on a modified Solvay Cycle producing refrigeration in the order of 77° K. at the base 22 of first stage 18 and refrigeration of 10° K. at the base 24 of second stage 20.

A first cryopanel 30 in the shape of a closed bottom (except for the necessary aperture to fit the panel 30 over second stage 20 without contact therewith) is affixed to bottom 22 of first stage 18. The cryopanel 30 is preferably constructed from a metallic sheet material having high conductivity such as copper. All of the inner 32, 34, and outer 36, 38 surfaces of cryopanel 30 are provided with a highly polished surface usually by depositing a bright nickel plating on these surfaces.

From a point 40 to a point 42, proceeding down inner wall 32 across bottom inner wall 34, the inside surface of cryopanel 30 is provided with a coating that will absorb radiant energy. While such coating materials are well-known, one that has been found to be effective is a black epoxy paint manufactured and sold by Allentown Paint Co. under the brand name Black Epoxy Enamel & Activator. The coating is preferably placed on the surface at this location in order to prevent high temperature radiation from affecting the operation of second cryopanel 50 as will hereinafter be more fully described. However, placing a coating only on surface 34 of cryopanel 30 is effective to achieve the pumping speeds as set out below.

The second cryopanel 50, also in the form of a closed bottom open top cylinder, is manufactured in an identical manner to cryopanel 30. Again, it is preferable that cryopanel 50 be made of a conductive material and is provided on its outer surface 52 with a bright nickel plating. Cryopanel 50 is made to be of a smaller diameter and a shorter length than panel 30 so it can be affixed in an inverted position to the second stage 20 of refrigerator 14. The inner surface 54 of cryopanel 50 is covered with an activated charcoal material in particulate form. The charcoal is bonded to the inner surface of cryopanel 50 with epoxy in a manner well-known to workers skilled in the art.

If water vapor in a significant amount is present in the vacuum environment, the apparatus of the present invention can be fitted with a chevron baffle shown generally as 60 in the drawing. The baffle 60 is shown in dotted line, as it is not essential to the functioning of the apparatus shown in the drawing. The chevron baffle 60 can be manufactured from a conductive material such as copper and provided with a polished surface via a bright nickel plating or a radiation absorbing surface as will hereinafter be more fully described.

The apparatus of the drawing is used to provide ultra-clean vacuums below $10^{-6}$ Torr. by removing the gases set out in Table I below on the surfaces of the cryopump panels as noted.

TABLE I

| Gas Group | I | II | III |
|---|---|---|---|
| Surface | 32,36 | 52 | 56 |
| Gas Removed | $H_2O$ | $N_2$ | $H_e$ |
| Gas Removed | $CO_2$ | $O_2$ | $H_2$ |
| Gas Removed | | $A_R$ | $N_e$ |
| Gas Removed | | CO | |
| Gas Removed | | $CH_4$ | |
| Gas Removed | | $F_2$ | |

As is shown in Table I, water vapor and carbon dioxide adhere to the inner and outer polished surfaces (32, 36) of cryopanel 30. Nitrogen, oxygen, argon, carbon monoxide, methane, and halogenated hydrocarbons, such as sold under the Freon trademarks, are removed on the outer polished surface 52 of cryopanel 50. Lastly, helium, hydrogen and neon are adsorbed on the charcoal layer 56 on the inner surface of cryopanel 50. In the apparatus of the drawing without a chevron baffle, Group I gases can be pumped on surface 52 but not surface 56, and Group II gases can be pumped on surface 56 as well as surface 52. The effects of the various levels of temperature on cryopumping gases is well-known and is discussed extensively in the literature. Surfaces 32, 36 (polished) are generally at a temperature of between 40° and 120° K.; the polished surfaces 52 and the absorbent layer 56 are generally at a temperature of between 10° and 25° K. so that the gases are caused to stick to these surfaces and thus are removed from a location where they can affect the vacuum.

It has been discovered that radiation in the order of 300° K. can strike cryopanel 30 on the inner surface 32. With this surface having a high polish, the radiation can be reflected toward the charcoal material 56 and thus reduce the efficiency of the charcoal in removing helium, hydrogen and neon, which are the most difficult gases to remove from a vacuum environment.

Normally, incident radiation at three levels can be expected to impinge upon the surfaces noted in Table I. The levels of radiation are grouped as (a) approximately 300° K.; (b) 40° to 120° K.; and (c) 10° to 25° K. Without the radiation absorbing layer on the bottom inner surface of cryopanel 30, all levels of incident radiation would fall upon the charcoal layer as set out above. With the radiation absorbing layer, incident radiation of the latter two classifications (e.g. b, c) only strikes the charcoal layer, thus maintaining the charcoal's efficiency to cryosorb helium, hydrogen and neon as well as any Group II gases that may impinge upon this surface.

There is shown in the FIGURE a conventional chevron baffle 60 which may be used to close the open end of cryopanel 30. Chevron baffle 60 is of a conventional type and is used to restrict the flow of Group I gas into the colder part of the cryopump. According to published data, approximately 35% of the Group II and III gases hitting the chevron baffle passes into the low temperature area defined by the inner surface 32 of cryopanel 30 and the inner and outer surfaces of cryopanel 50. A further discussion of chevron baffles is set out in a publication entitled "Vacuum Technology and Space Simulation" by D. J. Santeler, D. H. Holkboer, D. W. Jones, and F. Pagano, identified as NASA SP-105 published by the Scientific and Technical Information of the National Aeronautics and Space Administration (1966). This reference clearly discusses the state of the art in using chevron baffles of the type which may be used with the present invention.

The chevron baffle can be one having a highly polished surface which would then function to impede class 1 gases from being passed into surface 52.

Set out in Table II below are a series of tests which were conducted with an apparatus such as shown in the drawing with and without the radiation absorbing layer on the inner surface 32 and 34 of cryopanel 30 as described above.

TABLE II

| Gas | Without Layer | | | With Layer | | |
|---|---|---|---|---|---|---|
| | Pump Speed | Panel Temp. ° K. | | Pump Speed | Panel Temp. ° K. | |
| | L/S[a] | $T_2$[b] | $T_1$[c] | L/S | $T_2$ | $T_1$ |
| Helium | 85 | 13 | 39 | 310 | 10 | 43 |
| Hydrogen | 530 | 13 | 38 | 900 | 10 | 45 |
| Nitrogen | 975 | 13 | 38 | 975 | 12 | 54 |

[a]Liters per second
[b]Second Stage of Refrigerator
[c]First Stage of Refrigerator From the results of Table II, it is apparent that the reduced temperature of the second stage panel 50 and the higher temperature of the first stage panel indicate that the radiation absorbing layer (black paint) is effective in absorbing incident radiation and preventing it from being absorbed by the charcoal. The reduced temperature of the charcoal permits it to be more effective in pumping helium and hydrogen as reflected in the greater speeds set out in Table II.

Table III sets forth a series of results for an apparatus according to the invention when using a polished number 1 chevron baffle compared to not using a chevron baffle. The parameters measured in Table III are the same as those for Table II.

Table III

| Gas | With Polished #1 Chevron | | | Without #1 Chevron | | |
|---|---|---|---|---|---|---|
| | Speed | Panel Temp. ° K. | | Speed | Panel Temp. ° K. | |
| | L/S | $T_2$ | $T_1$ | L/S | $T_2$ | $T_1$ |
| Helium | 200 | 10 | 42 | 310 | 10 | 43 |
| Hydrogen | 500 | 10 | 44 | 900 | 10 | 45 |
| Nitrogen | 400 | 11 | 49 | 975 | 12 | 54 |

From Table III it is apparent, when compared with the results in Table II in a cryopump without the radiation absorbing layer, use of a chevron baffle increases the pumping speed of helium, however, not to the same level as without the baffle. The chevron baffle helps to decrease the heat load on the second stage and thus on the charcoal layer, however, the cost is in reduced pumping speeds of Group II gases because of the blockage of gas flow to the second stage cryopanel.

The method of the present invention would be applicable to other types of cryopumps as set out in the literature as long as a radiation absorbing surface is placed between the surfaces that normally pump Group II (Table I) and Group III (Table I) gases so that the heat load on the surface used to cryopump helium, hydrogen and neon is reduced, and providing there is not a significant amount of water vapor in the vacuum so the chevron baffle can be eliminated.

The apparatus of the present invention combines the discovery in the form that facilitates achieving the placement of the radiation absorbing layer so that incident radiation of approximately 300° K. is not reflected into the surface that cryopumps (cryosorbs) helium, hydrogen and neon.

The method and apparatus of the present invention are particularly effective at high vacuums (e.g. below $10^{-6}$ Torr.) because at vacuums of this level hydrogen may be outgased from the metal and thus prevent achieving of a "clean vacuum". With the apparatus of the present invention, such outgased hydrogen is cryopumped on the charcoal layer, which has the benefit of being cooled by the second stage of the cryogenic refrigerator.

It would be possible to configure the present invention in such a way that refrigeration could be supplied other than by a cryogenic refrigerator. For instance, supplies of liquid nitrogen and liquid helium could be maintained and pumped through the vacuum chamber wall to cool the respective cryopanels, and thus achieve the same level of refrigeration which is most conveniently done by use of a closed cycle cryogenic refrigerator.

While charcoal is the preferred cryosorbent material, others known to workers skilled in the art can be used advantageously with the method and apparatus of the invention.

Having thus described by invention, what I desire to be secured by Letters Patent of the United States is set forth in the following claims.

I claim:

1. A cryopumping apparatus comprising in combination:

a base to fix said apparatus to a vacuum chamber;

a first refrigeration source supported by said base and constructed to provide a temperature source at less than 120° K. inside said vacuum chamber;

a second refrigeration source supported by said base and constructed to provide a temperature source at less than 25° K. inside said vacuum chamber;

a first panel adapted to be supported by said base in said vacuum chamber to be cooled by said first refrigeration source and having the shape of a cylinder with a closed bottom and open top, said panel having a polished outer and inner surface, the inner bottom surface of said first panel being coated with a radiant absorbing coating; and a second panel in the form of a closed bottom open-top cylinder of smaller diameter and shorter length than said first panel supported in an inverted position inside said first panel without contacting said first panel, said second panel cooled by said second refrigeration source, and having a polished outer surface and a gas absorbing material on said inner surface, said second panel being of a size and shape to permit portions of a vacuum environment to circulate between said first and second cryopanels and contact said gas absorbing material.

2. An apparatus according to claim 1 wherein said radiant absorbing coating is a black epoxy resin paint.

3. An apparatus according to claim 1 wherein said gas adsorbing material is activated charcoal.

4. An apparatus according to claim 1 wherein a polished chevron baffle closes the open end of said first panel.

5. An apparatus according to claim 1 wherein a chevron baffle having black epoxy paint covered surfaces closes the open end of said first panel.

* * * * *